United States Patent [19]

Kobayashi et al.

[11] 4,227,490

[45] Oct. 14, 1980

[54] ELECTRONIC CONTROL FUEL INJECTION SYSTEM WHICH COMPENSATES FOR FUEL DRYING IN AN INTAKE PASSAGE

[75] Inventors: Nobuyuki Kobayashi; Toshio Suematsu; Minoru Bitou, all of Toyota, Japan

[73] Assignee: Toyota Jidosha Kogyo Kabushiki Kaisha, Toyota, Japan

[21] Appl. No.: 919,296

[22] Filed: Jun. 26, 1978

[30] Foreign Application Priority Data

Feb. 13, 1978 [JP] Japan ..... 53-14056

[51] Int. Cl.[3] ..... F02B 3/00

[52] U.S. Cl. ..... 123/492; 123/493

[58] Field of Search ..... 123/32 EL, 32 EH, 97 B, 123/98

[56] References Cited

U.S. PATENT DOCUMENTS

| | | | |
|---|---|---|---|
| 2,292,091 | 8/1942 | Rhodes | 123/98 |
| 2,993,484 | 7/1961 | Gallman | 123/97 B |
| 2,993,485 | 7/1961 | Cornelius | 123/97 B |
| 3,672,345 | 6/1972 | Monpetet | 123/32 EH |
| 3,690,305 | 9/1972 | Shimada et al. | 123/97 B |
| 3,703,162 | 11/1972 | Aono | 123/97 B |
| 3,720,191 | 3/1973 | Rachel | 123/32 EL |
| 3,727,591 | 4/1973 | Suda | 123/32 EH |
| 3,742,920 | 7/1973 | Black | 123/97 B |
| 3,842,811 | 10/1974 | Shinoda et al. | 123/32 EH |
| 3,926,153 | 12/1975 | Reddy | 123/32 EL |
| 4,010,717 | 3/1977 | Taplin | 123/32 EH |
| 4,015,563 | 4/1977 | Drews et al. | 123/32 EH |
| 4,126,107 | 11/1978 | Haradu et al. | 123/32 EH |
| 4,144,864 | 3/1979 | Kato et al. | 123/32 EL |

FOREIGN PATENT DOCUMENTS

| | | | |
|---|---|---|---|
| 2250756 | 4/1974 | Fed. Rep. of Germany | 123/32 EL |
| 2241694 | 3/1975 | France | 123/32 EH |

*Primary Examiner*—Charles J. Myhre
*Assistant Examiner*—Raymond A. Nelli
*Attorney, Agent, or Firm*—Stevens, Davis, Miller & Mosher

[57] ABSTRACT

An improved electronic control fuel injection system is disclosed wherein, during acceleration, fuel of a given amount is supplied to an engine which is commensurate with a sum formed of the amount of fuel to be burned with air in a combustion chamber, and an amount of fuel to be consumed so as to wet or moisten the inner surfaces of an intake port and the like which have been dried due to a prolonged interruption in the supply of fuel to an engine during a preceding deceleration condition. The fuel supplied to an engine through an injection valve operated by the disclosed fuel injection system at the beginning of acceleration immediately subsequent to the interruption of the fuel supply for a predetermined duration forms, with the incoming air, a desired air-fuel ratio, so that a mixture charge may be burned at the beginning of the acceleration without engine misfires occurring. The given amount of fuel supplied at the beginning of the immediately subsequent acceleration is supplied to an engine by a control circuit which forms a pulse output separately from the control-signal-generating circuit pulse output normally associated with a fuel injection system and thus does not resort to measures to increase the width of the pulses supplied from the control-signal-generating circuit. This ensures a smooth build-up of engine torque and prevents the imposition of shocks on an automobile, and results in an effective utilization of the first fuel supply pulse from the control-signal-generating circuit, immediately after the subsequent acceleration of an engine.

2 Claims, 4 Drawing Figures

ELECTRONIC CONTROL FUEL INJECTION SYSTEM WHICH COMPENSATES FOR FUEL DRYING IN AN INTAKE PASSAGE

BACKGROUND OF THE INVENTION

This invention relates to an electronic control fuel injection system for electronically controlling the amount of fuel to be supplied through an injection valve into an engine.

The use of an electronic control fuel injection system for an engine to control the emission of harmful constituents of exhaust gases, as well as to reduce fuel consumption by interrupting the supply of fuel to an engine while the engine remains in a decelerating condition is known. When the supply of fuel is interrupted, fuel droplets, which normally cling to the inner surfaces of an intake system, e.g., an intake port and the like, before the interruption of the fuel supply, are delivered to a combustion chamber and are consumed therein. If the interruption in the fuel supply is considerably long, then the inner surfaces of an intake port and the like are dried to the extent that no fuel droplets are present. In addition, the interruption of the supply of fuel causes residual gases to be completely scavenged by air from a combustion chamber in an engine, and hence no residual remains in the combustion chamber. Meanwhile, when an engine is accelerated again after a long interruption in the fuel supply, an injection valve is operated by the control-signal-generating circuit which determines the optimum opening duration of an injection valve in accordance with the operational parameters of an engine, so that an optimum amount of fuel is injected through the injection valve into an engine. However, when this occurs, the amount of fuel thus injected is insufficient to afford a mixture charge of a desired air-fuel ratio called for by the control-signal-generating circuit, because of the lack or absence of a sufficient amount of fuel droplets which normally reside in and coat an intake pipe and the like. Thus, fuel is not always supplied in its entirety to a combustion chamber, but part of the fuel of a given amount is consumed so as to wet or moisten the inner surfaces of an intake system. As a result, the air-fuel ratio of a mixture charge in a cylinder upon acceleration, following a long duration of the interrupted fuel supply, remains, for the duration of several cycles of an engine, at a value higher than a given value (a lean mixture), so that the engine is likely to misfire. Also, when an air-fuel ratio of a mixture charge in a cylinder reaches a level which allows for ignition, a sharp rise in torque is produced in the engine, at the time of subsequent acceleration, so that an undesirable shock is imposed on an automobile. .

SUMMARY OF THE INVENTION

Accordingly, an object of the present invention is to provide an electronic control fuel injection system which prevents misfires in an engine after a predetermined duration of interruption of the fuel supply to an engine occurs, thereby allowing the smooth build-up of a torque in an engine.

According to the present invention, an improved electronic control fuel injection system is provided wherein fuel of a given amount is supplied to an engine which is commensurate with the sum of (1) the amount of fuel to be burned with air residual in a combustion chamber, and (2) the amount of fuel to be consumed so as to wet or moisten the inner surfaces of an intake port and the like which have been dried, when an engine is shifted from a decelerating condition to a subsequent accelerating condition, after the supply of fuel has been interrupted for a predetermined time duration. The fuel supplied to an engine through an injection valve operated by a control-signal-generating circuit after the beginning of a subsequent acceleration is then supplied to a combustion chamber in an engine at a given air-fuel ratio, so that a mixture charge may be properly burned without incurring engine misfires. Fuel of a given amount at the starting of the aforenoted subsequent acceleration is supplied to an engine in accordance with a control pulse produced in a circuit which is separate from the control-signal-generating circuit normally associated with an electronic fuel injection system. As a result, no resort is had to measures for increasing the width of a pulse supplied from the control-signal-generating circuit to an injection valve for compensating for the drying of the intake passage. This ensures a smooth build-up of torque in an engine and eliminates the imposition of a shock on an automobile and, in addition, allows for an effective utilization of the first fuel supply pulse from the control-signal-generating circuit delivered immediately after the subsequent acceleration of an engine begins.

More particularly, according to a principal aspect of the invention, there is provided an electronic control fuel injection system of the type described, which includes: a fuel-supply-interrupted-duration-detecting means for detecting that a fuel supply interruption exceeds a predetermined value; subsequent-acceleration-detecting means for detecting the shifting of an engine from its decelerating condition to its accelerating condition; and an injection-valve-actuating means for actuating the injection valve so as to supply fuel in a predetermined amount to an engine, upon the subsequent acceleration of an engine after a predetermined interruption duration in the fuel supply in response to signals from the aforenoted fuel-supply-interrupted-duration-detecting means and the subsequent-acceleration-detecting means.

DESCRIPTION OF THE PREFERRED EMBODIMENTS

Figure 1:
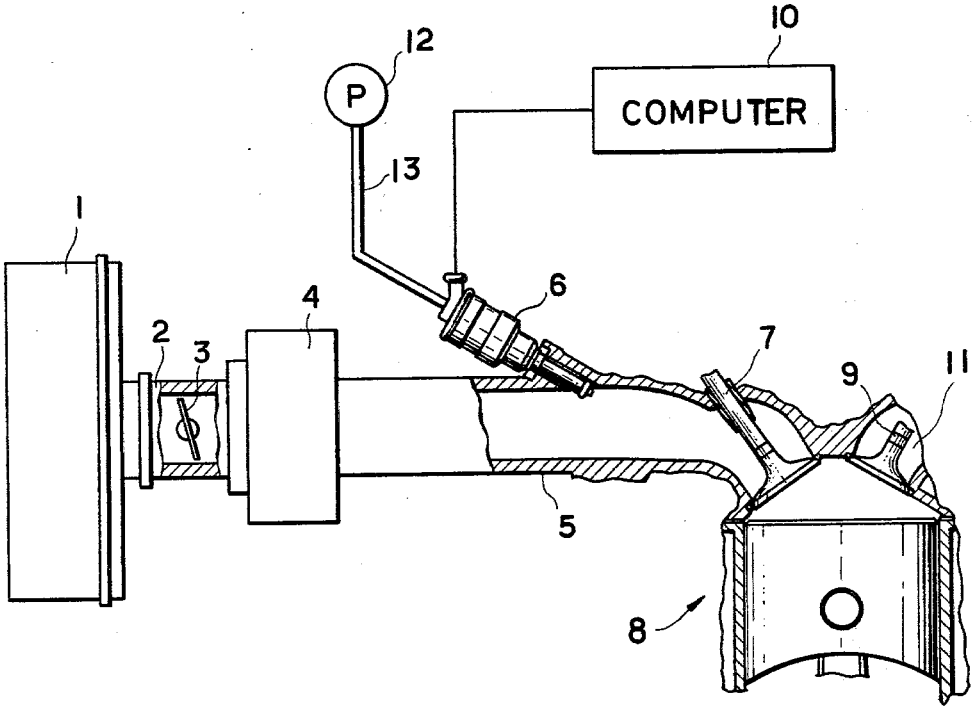
FIG. 1 is a schematic view of an electronic control fuel injection system according to the present invention.

Referring to FIG. 1, an air cleaner 1 is coupled to a throttle body 2 which houses a throttle valve 3, the latter cooperating with an accelerator pedal (not shown) at a driver's seat. A downstream end of the throttle body 2 is coupled to a surge-reservoir 4 which in turn is coupled to respective cylinders through the medium of intake pipes 5 of a number corresponding to the number of cylinders in an engine 8. An intake valve 7 is provided at an entrance of each combustion chamber, while an exhaust pipe 11 is connected to a downstream side of the combustion chamber. One injection valve 6 is provided on each intake pipe 5. The injection valve 6 is operated according to a control signal from a computer 10. Fuel pressurized by a fuel pump 12 is delivered therefrom via a passage 13 to the injection valve 6.

Figure 2:
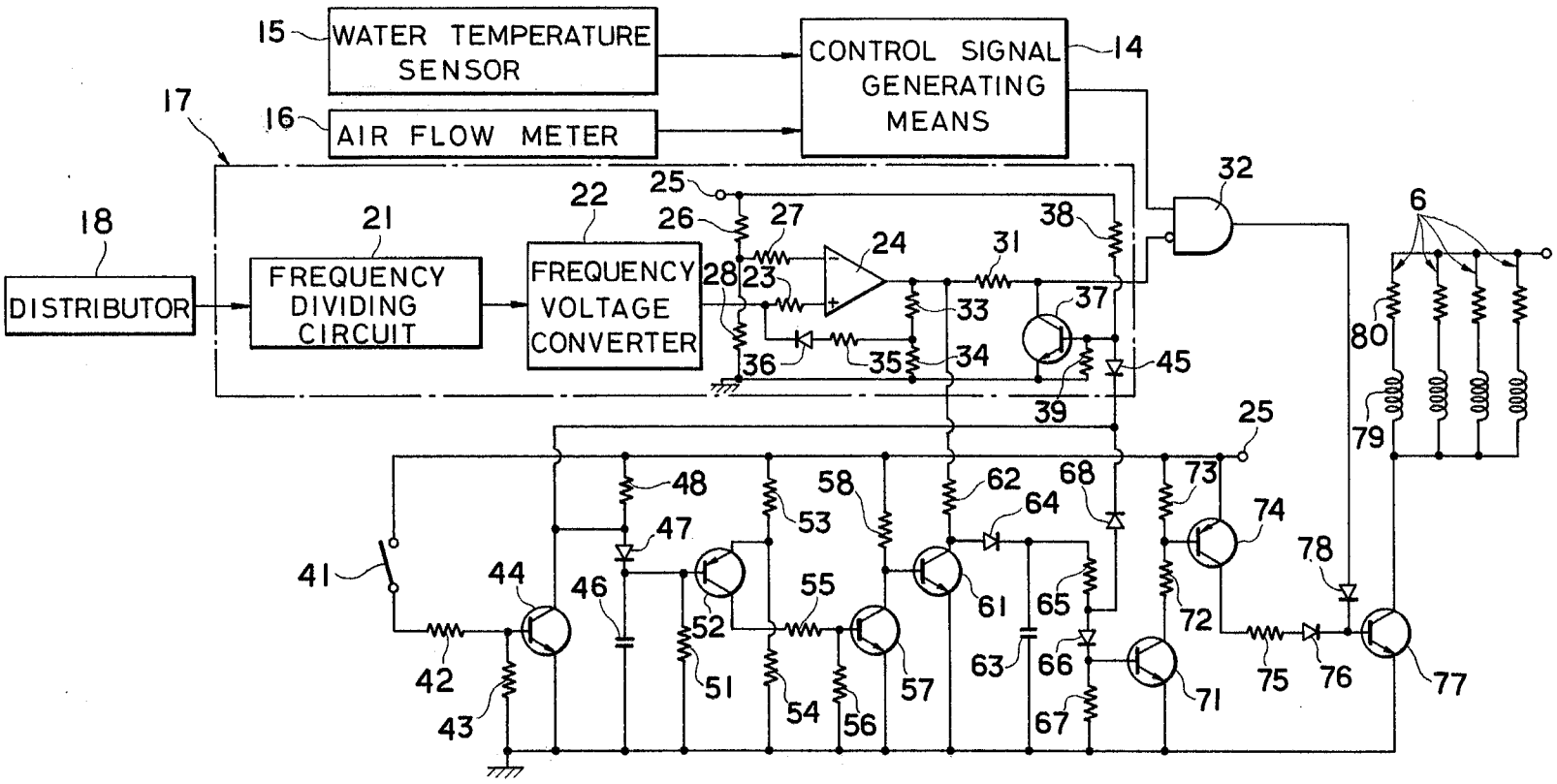
FIG. 2 is a detailed circuit diagram for a computer in the electronic control fuel injection system of FIG. 1.

FIG. 2 is a detailed circuit diagram of a computer 10. As shown, a conventional control-signal-generating means 14 disclosed in the U.S. Pat. No. 3,898,964 receives signals from a water-temperature sensor 15 adapted to detect the temperature of cooling water for an engine, and from another sensor adapted to detect operational parameters for an engine, such as a signal from an air flow meter 16 or the like, which is adapted to detect the flow rate of intake air. The control-signal-generating means computes an optimum amount of fuel required for an engine, and delivers the results of the computation in the form of a pulse width at its output terminal.

Shown at 17 is a fuel-supply-interrupting circuit. An ignition pulse delivered from a distributor 18, which represents the rotational speed of an engine, is fed to a frequency-to-voltage convertor via a frequency-dividing circuit 21. Thus, a D.C. voltage of a level proportional to the rotational speed of an engine is generated at an output terminal of the frequency-to-voltage convertor 22. The output of the frequency-to-voltage convertor 22 is fed, via a resistor 23, to a non-inverting terminal (inversion from one logical state to the other), of a comparator 24. Shown at 25 is a positive voltage terminal maintained at a given voltage level. An inverting terminal of the comparator 24 is supplied with a reference voltage via resistors 26, 27, 28. The output terminal of the comparator 24 is connected via a resistor 31 to an AND circuit 32. The comparator circuit logical state, i.e., the signal from the resistor 31 and the AND circuit 32, is inverted to the other logical state at the input terminal of the AND circuit 32. The output signal from the control-signal-generating means 14 is delivered to the other input terminal of the AND circuit 32. A positive feedback circuit for the comparator 24 is completed by means of resistors 33, 34, 35 and a diode 36. A NPN type transistor 37 is positioned between the inverting input terminal of the AND circuit 32 and a grounding terminal. Resistors 38, 39 determine a base voltage for the transistor 37.

Shown at 41 is a throttle switch which cooperates with the throttle valve 3. Switch 41 is brought to its closed position, when the throttle valve 3 assumes its closed position, and to its open position, when the throttle valve assumes its open position. One end of the throttle switch 41 is connected to a positive voltage terminal 25, while the other end thereof is grounded via resistors 42, 43. A base of the NPN type transistor 44 is connected to a junction of the resistors 42 and 43, while the emitter of transistor 44 is grounded, and the collector thereof is connected, via a diode 45, to the base of transistor 37. A capacitor 46 is connected to a positive voltage terminal 25 via a diode 47 and resistor 48. An anode side of the diode 47 is connected to a collector of the transistor 44. A resistor 51 is arranged in parallel with the capacitor 46. The base of a PNP type transistor 52 is connected to the capacitor 46, while the emitter of the transistor 52 is connected to a junction of the resistors 53 and 54, and the collector thereof is grounded via resistors 55, 56. The base of the NPN type transistor 57 is connected to a junction of the resistors 55 and 56, while the emitter thereof is grounded, and the collector thereof is connected via a resistor 58 to the terminal 25. The base of a NPN type transistor 61 is connected to the collector of the transistor 57, while the emitter thereof is grounded, and the collector thereof is connected via a resistor 62 to an output terminal of the comparator 24. A capacitor 63 is connected via diode 64 to the collector of the transistor 61. A series circuit consisting of a resistor 65, a diode 66, and a resistor 67 is provided in parallel with the capacitor 63. the junction of the resistor 65 and diode 66 is connected, via a diode 68, to the collector of the transistor 44. The base of the NPN type transistor 71 is connected to a junction of diode 66 and resistor 67, while the emitter of the transistor 71 is grounded, and the collector thereof is connected via resistors 72, 73 to the positive voltage terminal 25. The base of a PNP type transistor 74 is connected to a junction of the resistor 72 and the resistor 73, while the emitter of transistor 74 is connected to the terminal 25, and the collector thereof is connected, via a resistor 75 and diode 76, to a base of the power transistor 77. The output terminal of the AND circuit 32 is also connected, via a diode 78, to the base of the power transistor 77. In this respect, the diodes 76, 78 form an OR (logic sum) circuit.

The collector of the power transistor 77 is connected to the injection valves 6, the number of which corresponds to the number of cylinders. Each injection valve 6 consists of a resistor 80 and a coil 79.

Description will now be provided of the fuel supply interrupt operation occurring when an engine remains in a decelerating condition.

When the throttle valve 3 is closed at a time t1, i.e., when an engine remains in a decelerating condition, the throttle switch 41 is closed, while the transistor 44 is brought to its closed condition. Accordingly, the transistor 37 in the fuel-supply-interrupting circuit 17 is brought to its open condition at the time of t1. In addition, when an engine is in its decelerating condition and the rotational speed thereof is maintained over a predetermined value, then an output of comparator 24 becomes a logical "1" (high voltage level). The "1" output is fed to the inverting input terminal of the AND circuit 32, so that the output of the AND circuit 32 is maintained at "0" (low voltage level), irrespective of the output of the control-signal-generating means 14. This precludes the supply of an electric current to the injection valves 6, so that the fuel supply to an injection valve may be interrupted for the duration from the timing t1 to the timing of the subsequent acceleration.

Before the timing t1, the throttle switch 41 remains in its open position, and the transistor 44 remains in its open condition, so that the capacitor 46 is maintained at a high voltage through the medium of resistor 48 and diode 47. However, at the timing t1, the transistor 44 becomes closed and an anode side of the diode 47 is brought to a low voltage level, so that the capacitor 46 is discharged from the timing t1 on, through the medium of the resistor 51 with a predetermined time-constant. If the fuel supply remains interrupted for a given duration, at the timing t2 that is beyond a predetermined duration from the timing t1, the voltage on the capacitor 46 is lowered below a given voltage level, so that the transistor 52 is brought to its closed condition. As a result, the transistor 57 switches to a closed condition, while the transistor 61 switches to an open condition. Thus, the capacitor 63 is immediately charged at the timing t2 according to a "1" output of the comparator 24. Since the transistor 44 remains closed, and the anode side of diode 66 is grounded through the diode 68 and transistor 44, the transistor 71 is maintained in its open condition, irrespective of the charge condition on the capacitor 63. Thus, the transistor 74 is operated, so that a pulse is prevented from being delivered to the base of the power transistor 77 via diode 76. If an engine remains in its idle condition as well, the throttle switch 41 may possibly be closed over a predetermined time duration. However, during the idle running of an engine, an output of the comparator 24 is maintained at a "0" level, so the capacitor 63 will not be charged.

When an engine is shifted from its decelerating condition to a subsequent accelerating condition at the timing t3, the throttle valve 3 is opened, and the throttle switch 41 is immediately brought to its open position. As a result, the transistor 44 switches to an open condition, the transistor 37 switches to a closed condition, and the input to the inverting input terminal of the AND circuit 32 switches to a "0" level. In this manner, the output of the control-signal-generating means 14 is fed via AND circuit 32 to the power transistor 77 from the time t3 on, so that fuel is supplied through the injection valves 6 into an engine. On the other hand, prior to the time t3, the anode side of diode 66 remains at a "0" level. However, at the timing t3, when the transistor 44 is switched to its open condition, the transistor 61 switches to its closed condition, so that the transistor 71 switches to its closed condition. The capacitor 63 is discharged via resistors 65, 67, while the transistor 71 is maintained in its closed condition during the time ending with the timing t4, at which a voltage of the capacitor 63 is lowered below a given voltage level, i.e., from the timing t3 to the timing t4; that is, a given duration beyond the timing t3. When the transistor 71 is closed, then the transistor 74 is also closed, and so is the power transistor 77, so that the injection valves 6 are maintained opened during the time from the timing t3 to the timing t4, so that fuel may be supplied to an engine in a given amount.

Figure 3:
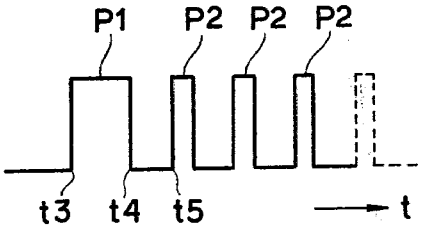
FIG. 3 is a wave form of pulses generated in the electronic control fuel injection system according to the present invention which are fed to the injection valve; and, FIG. 4 is a plot illustrative of the engine torques caused by the electronic control fuel injection system of the invention.

FIG. 3 represents a wave form of the output of the power transistor 77. A pulse P1 generated for the duration from t3 to t4 is a pulse which is produced due to the closing of the transistor 71, pulses P2 occurring after the timing t5 are produced due to a signal from the control signal generating circuit 14. In this manner, at the timing t3 when an engine is shifted from its decelerating condition to its accelerating condition, the pulse P1 is generated, with the result that fuel is supplied through the injection valve 6 into an engine in a given amount, and thus the inner surfaces of an intake port and the like, which have been maintained in a dried condition, immediately get wet or moistened from incoming fuel droplets. Accordingly, the fuel injected through the injection valve 6 according to the pulse P2 generated due to a signal from the control signal generating circuit 14 is not consumed in the wetting or moistening of the inner surfaces of an intake port and the like, but rather, a mixture charge of a given air fuel ratio is supplied to a combustion chamber in an engine, so that a torque which has been computed by means of the control signal generating means 14 may be produced by an engine, without engine misfires, upon the commencement of the subsequent acceleration of an engine.

Figure 4:
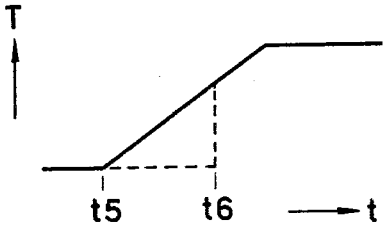

FIG. 4 is a graphical representation of the torque T produced in an engine. Engines equipped with electronic control fuel injection systems according to the present invention may produce torques in exact response to the width of a pulse produced in the control signal generating means 14, so that the torque smoothly follows an upward curve shown by a solid line in FIG. 4. The broken line refers to the result of control of the prior art electronic control fuel injection system, wherein engine misfires may occur during the time from the starting of the subsequent acceleration to the timing t6, i.e., until several cycles of an engine have lapsed, with the result that a torque is produced at the timing t6 abruptly, thus leading to a large shock being imposed on an automobile.

As is apparent from the foregoing description of the electronic control fuel injection system according to the present invention, when an engine is shifted from its decelerating condition to its accelerating condition, after an interrupted duration of the fuel supply for an engine has exceeded a predetermined value, the injection valve 6 is brought to its open position, thereby wetting or moistening the inner surfaces of an intake port and the like quickly. Thus, a torque produced in an engine may follow a smooth upward curve from the starting of the subsequent acceleration thereby preventing the production of shocks on the vehicle.

According to the present invention, in case an interrupted duration of the fuel supply remains below a predetermined value, i.e., is relatively short in time duration, when the subsequent acceleration is commenced, no pulse P1 will be generated. If the interrupted duration of the fuel supply is relatively short, fuel droplets in a sufficient amount remain clinging to the inner surfaces of an intake port and the like, such that at the commencement of the immediately subsequent acceleration, additional fuel need not be supplied. This prevents the supply of an unwanted amount of fuel due to the pulse P1 to the engine, as well as any adverse influence on the running of an engine which might be caused by the extra fuel.

According to the present invention, the supply of fuel required, upon the commencement of the subsequent acceleration is achieved without increasing the width of pulse P2. Rather, the supply of required fuel is accomplished by generating the pulse P1, independently of the pulse P2. Accordingly, the engine will not misfire even during a single cycle, but may produce a desired torque, immediately after initiation of acceleration following a long interruption in the supply of fuel to the engine.

While the present invention has been described herein with reference to certain exemplary embodiments thereof, it should be understood that various changes, modifications and alterations may be effected without departing from the spirit and the scope of the present invention, which is defined in the appended claims.

What is claimed is:

1. An electronic control fuel injection system of the type in which the supply of fuel through an injection valve to an engine is interrupted during the time that said engine remains in its decelerating condition comprising:

an injection valve provided in an intake system for said engine which is opened or closed in response to an electric current supplied thereto so as to supply fuel to said engine;

control-signal-generating means for computing an open duration of said injection valve in connection with the operational parameters of said engine and providing a fuel control output signal corresponding to said computation;

gate means for precluding the passing of said output signal from said control signal generating means therethrough, when the rotational speed of said engine remains over a predetermined value but said engine is in a decelerating condition;

fuel-supply-interruption-duration-detecting means for detecting that the time duration of interrupted fuel supply to said engine exceeds a predetermined value;

fuel-amount-increasing means responsive to the output of said fuel-supply-interruption-duration detecting means for generating an output pulse of a predetermined width when said engine is shifted from its decelerating condition to its accelerating condition after said fuel-supply-interruption time duration has exceeded said predetermined value; and, actuating means for controlling an electric current to be supplied to said injection valve for actuating the same, said actuating means being operated according to the logical-sum of output signals from said control signal generating means and said fuel-amount-increasing means.

2. An electronic control fuel injection system of the type in which the supply of fuel through an injection valve to an engine is interrupted during the time that said engine remains in its decelerating condition, comprising:

a throttle valve provided in an intake system of said engine;

an injection valve provided in said intake system which is opened or closed in response to an electric current supplied thereto so as to supply fuel to said engine;

means for maintaining a first capacitor element at a predetermined voltage when said throttle valve remains opened, and for discharging said capacitor with a predetermined time-constant, during the time that said throttle valve remains in its closed position;

means for charging a second capacitor element to a predetermined voltage after a voltage stored by said first capacitor element has been lowered below a predetermined value, and the rotational speed of said engine remains over a predetermined value;

means for maintaining a terminal at a voltage level which corresponds to the voltage stored by said second capacitor element;

means for forming a short-circuited path for said terminal during the time that said throttle valve remains in its closed position; and, means for supplying an electric current to said injection valve for actuating same, during the time that a voltage at said terminal remains over a predetermined value.

* * * * *